US011725320B2

(12) United States Patent
Hall

(10) Patent No.: US 11,725,320 B2
(45) **Date of Patent: *Aug. 15, 2023**

(54) SYSTEM AND METHOD FOR TUFTING SCULPTURED AND MULTIPLE PILE HEIGHT PATTERNED ARTICLES

(71) Applicant: Card-Monroe Corp., Chattanooga, TN (US)

(72) Inventor: Wilton Hall, Ringgold, GA (US)

(73) Assignee: Card-Monroe Corp., Chattanooga, TN (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/492,105

(22) Filed: Oct. 1, 2021

(65) Prior Publication Data

US 2022/0018049 A1 Jan. 20, 2022

Related U.S. Application Data

(63) Continuation of application No. 16/459,148, filed on Jul. 1, 2019, now Pat. No. 11,136,702, which is a (Continued)

(51) Int. Cl.
*D05C 15/22* (2006.01)
*D05C 15/08* (2006.01)

(Continued)

(52) U.S. Cl.
CPC ..... *D05C 15/22* (2013.01); *D05C 11/00* (2013.01); *D05C 15/08* (2013.01); *D05C 15/14* (2013.01);

(Continued)

(58) Field of Classification Search
CPC ..... D05C 15/22; D05C 15/08; D05C 15/14; D05C 15/145; D05C 15/18; D05C 15/28;

(Continued)

(56) References Cited

U.S. PATENT DOCUMENTS 2,818,037 A 12/1957 McNutt
2,836,134 A 5/1958 Harrison (Continued)

FOREIGN PATENT DOCUMENTS

CN 1694985 A 11/2005
CN 101765686 A 6/2010

(Continued)

OTHER PUBLICATIONS

International Search Report and Written Opinion for PCT/US2016/014465 dated Jul. 1, 2016.

(Continued)

*Primary Examiner* — Ismael Izaguirre

(74) *Attorney, Agent, or Firm* — Womble Bond Dickinson (US) LLP

(57) ABSTRACT

A system and method for tufting sculptured and multiple pile height patterned articles, including controlling placement of yarns fed to the needles of the tufting machine by a yarn feed mechanism to form varying patterns includes a backing support over which the backing is fed, and which lifts/and biases the backing to a raised position. As the backing material is fed through the tufting machine, a series of loopers or hooks engage and pick loops of yarns from the needles. The yarn feed mechanism will be controlled to create a tension in selected loops of yarns, to cause the backing material to be pulled against the bias or spring force applied by the backing support toward the needle plate of the tufting machine to create tufts of different pile heights.

21 Claims, 10 Drawing Sheets

Related U.S. Application Data continuation of application No. 15/594,950, filed on May 15, 2017, now Pat. No. 10,344,413, which is a continuation of application No. 14/930,769, filed on Nov. 3, 2015, now Pat. No. 9,657,419.

(60) Provisional application No. 62/235,834, filed on Oct. 1, 2015.

(51) Int. Cl.

| | |
|---|---|
| ***D05C 15/14*** | (2006.01) |
| ***D05C 15/18*** | (2006.01) |
| ***D05C 15/28*** | (2006.01) |
| ***D05C 15/30*** | (2006.01) |
| ***D05C 15/32*** | (2006.01) |
| ***D05C 15/34*** | (2006.01) |
| ***D05C 11/00*** | (2006.01) |
| *D05C 15/04* | (2006.01) |

(52) U.S. Cl.
CPC ..... *D05C 15/145* (2013.01); *D05C 15/18* (2013.01); *D05C 15/28* (2013.01); *D05C 15/30* (2013.01); *D05C 15/32* (2013.01); *D05C 15/34* (2013.01); *D05C 15/04* (2013.01)

(58) Field of Classification Search
CPC ..... D05C 15/30; D05C 15/32; D05C 15/34; D05C 15/04; D05C 11/00
See application file for complete search history.

(56) References Cited

U.S. PATENT DOCUMENTS 2,840,019 A 6/1958 Beasley
2,977,905 A 4/1961 Cobble, Sr. et al.
2,983,028 A 5/1961 Morrision
3,095,840 A 7/1963 Ballard
3,282,235 A 11/1966 Crawford
3,332,379 A 7/1967 Cobble, Sr. et al.
3,361,095 A 1/1968 Short
3,361,096 A 1/1968 Watkins
3,398,708 A 8/1968 Card
3,492,956 A 2/1970 Webb
3,585,948 A 6/1971 Cobble
3,618,542 A 11/1971 Zocher
3,635,177 A 1/1972 Gable et al.
3,780,678 A 12/1973 Short
3,842,767 A 10/1974 Short
3,881,432 A * 5/1975 Dodd ..... D05C 15/32 112/221
3,919,953 A 11/1975 Card et al.
3,937,156 A 2/1976 Spanel
4,014,278 A 3/1977 Jolley et al.
4,061,095 A 12/1977 Price
4,261,498 A 4/1981 Short
4,267,787 A 5/1981 Fukuda
4,303,025 A 12/1981 Bardsley
4,366,761 A 1/1983 Card
4,370,937 A 2/1983 Denny
4,384,538 A 5/1983 Slattery
4,397,249 A 8/1983 Slattery
4,399,758 A 8/1983 Bagnall
4,440,102 A 4/1984 Card et al.
4,445,447 A 5/1984 Bardsley et al.
4,491,078 A 1/1985 Ingram
4,501,212 A 2/1985 Slattery
4,503,787 A 3/1985 Watkins
4,509,439 A 4/1985 Densmore et al.
4,548,140 A 10/1985 Price et al.
4,549,496 A 10/1985 Kile
4,557,209 A 12/1985 Watkins
4,586,445 A 5/1986 Card et al.
4,619,212 A 10/1986 Card et al.
4,630,558 A 12/1986 Card et al.
4,658,739 A 4/1987 Watkins
4,693,190 A 9/1987 Slattery
4,754,718 A 7/1988 Watkins
4,790,252 A 12/1988 Bardsley
4,794,874 A 1/1989 Slattery
4,815,401 A 3/1989 Bagnall
4,815,403 A 3/1989 Card et al.
4,831,948 A 5/1989 Itoh et al.
4,836,118 A 6/1989 Card et al.
4,840,133 A 6/1989 Watkins
4,841,886 A 6/1989 Watkins
4,860,673 A 8/1989 Ward et al.
4,867,080 A 9/1989 Taylor et al.
4,883,009 A 11/1989 Haselbeerger et al.
4,903,624 A 2/1990 Card et al.
4,903,625 A 2/1990 Card et al.
4,981,091 A 1/1991 Taylor et al.
5,058,518 A 10/1991 Card et al.
5,143,003 A 9/1992 Dedmon
5,158,028 A 10/1992 Beyer
5,224,434 A 7/1993 Card et al.
5,295,450 A 3/1994 Neely
5,320,053 A 6/1994 Beasley
5,383,415 A 1/1995 Padgett, III
5,392,723 A 2/1995 Kaju
5,396,852 A 3/1995 Bardsley
5,461,996 A 10/1995 Kaju
5,499,588 A 3/1996 Card et al.
5,513,586 A 5/1996 Neely et al.
5,544,605 A 8/1996 Frost
5,549,064 A 8/1996 Padgett, III
5,562,056 A 10/1996 Christman, Jr.
5,566,630 A 10/1996 Burgess et al.
5,575,228 A 11/1996 Padgett et al.
5,588,383 A 12/1996 Davis
5,622,126 A 4/1997 Card et al.
5,706,744 A 1/1998 Card et al.
5,738,030 A 4/1998 Ok
5,743,201 A 4/1998 Card et al.
5,794,551 A 8/1998 Morrison et al.
5,806,446 A 9/1998 Morrison et al.
5,809,917 A 9/1998 McGowan
5,896,821 A 4/1999 Neely et al.
5,970,893 A 10/1999 Starita
5,974,991 A 11/1999 Bardsley
5,979,344 A 11/1999 Christman, Jr.
5,983,815 A 11/1999 Card
6,009,818 A 1/2000 Card et al.
6,014,937 A 1/2000 Lovelady
6,213,036 B1 4/2001 Slattery
6,244,203 B1 6/2001 Morgante et al.
6,263,811 B1 7/2001 Crossley
6,516,734 B1 2/2003 Morgante et al.
6,807,917 B1 10/2004 Christman et al.
6,834,601 B2 12/2004 Card et al.
6,834,602 B1 12/2004 Hall
6,895,877 B1 5/2005 Weiner
6,902,789 B2 6/2005 Funasako
6,951,590 B2 * 10/2005 Zafiroglu ..... D04B 23/10 156/72
7,080,601 B2 7/2006 Hayashi et al.
7,096,806 B2 8/2006 Card et al.
7,107,918 B2 9/2006 Caylor et al.
7,216,598 B1 5/2007 Christman et al.
7,222,576 B2 5/2007 Kilgore
7,267,062 B1 9/2007 Samilo
7,296,524 B2 11/2007 Beverly
7,347,151 B1 3/2008 Johnston et al.
7,426,895 B2 9/2008 Smith et al.
7,490,566 B2 2/2009 Hall
7,634,326 B2 12/2009 Christman, Jr. et al.
7,717,051 B1 5/2010 Hall et al.
7,946,233 B2 5/2011 Hall et al.
8,042,479 B2 10/2011 Mori
8,141,505 B2 3/2012 Hall et al.
8,141,506 B2 3/2012 Hall et al.
8,240,263 B1 8/2012 Frost et al.
8,359,989 B2 1/2013 Hall et al.
8,443,743 B2 5/2013 Christman, Jr.

(56) References Cited

U.S. PATENT DOCUMENTS

| | | | |
|---|---|---|---|
| 8,776,703 | B2 | 7/2014 | Hall et al. |
| 9,290,874 | B2 | 3/2016 | Mathews et al. |
| 9,657,419 | B2 | 5/2017 | Hall |
| 10,344,413 | B2 | 7/2019 | Hall |
| 11,136,702 | B2 | 10/2021 | Hall |
| 2006/0048690 | A1 | 3/2006 | Whitten et al. |
| 2009/0260554 | A1 | 10/2009 | Hall et al. |
| 2010/0064954 | A1 | 3/2010 | Hall et al. |
| 2010/0132601 | A1 | 6/2010 | Nakagawa et al. |
| 2012/0097082 | A1 | 4/2012 | Shanley |
| 2015/0292131 | A1 | 10/2015 | Mathews |
| 2017/0247825 | A1 | 8/2017 | Hall |

FOREIGN PATENT DOCUMENTS

| | | | |
|---|---|---|---|
| CN | 102535058 | A | 7/2012 |
| GB | 1077730 | A | 8/1967 |
| JP | 2002-115168 | A | 4/2002 |
| JP | 2003-003361 | A | 1/2003 |

OTHER PUBLICATIONS

Notification and International Preliminary Report on Patentability for PCT/US2016/014465 dated Apr. 12, 2018.
Extended European Search Report for related EP Application No. 16852209.2, dated Mar. 13, 2019.
Extended European Search Report for related application, EP 20170008.5, dated Sep. 10, 2020.

* cited by examiner

SYSTEM AND METHOD FOR TUFTING SCULPTURED AND MULTIPLE PILE HEIGHT PATTERNED ARTICLES

CROSS REFERENCE TO RELATED APPLICATIONS

The present Patent Application is a continuation patent application of previously-filed U.S. patent application Ser. No. 16/459,148 filed Jul. 1, 2019, which is a continuation of patent application of previously-filed U.S. patent application Ser. No. 15/594,950 filed May 15, 2017, now issued as U.S. Pat. No. 10,344,413, and which is a continuation of patent application of previously-filed U.S. patent application Ser. No. 14/930,769, filed Nov. 3, 2015, now issued as U.S. Pat. No. 9,567,419, and which is a formalization of previously filed, U.S. Provisional Patent Application Ser. No. 62/235,834, filed Oct. 1, 2015 by the inventors named in the present Application. This Patent Application claims the benefit of the filing date of the cited Provisional Patent Application according to the statutes and rules governing provisional patent applications, particularly 35 U.S.C. § 119(e), and 37 C.F.R. §§ 1.78(a)(3) and 1.78(a)(4). The specification and drawings of the Patent Applications referenced above are specifically incorporated herein by reference as if set forth in their entireties.

FIELD OF THE INVENTION

The present invention generally relates to tufting machines, and in particular, to systems and methods for controlling the placement of yarns at various pile heights within a backing material passing through a tufting machine to form sculptured patterned articles, including patterns having tufts of multiple, varying pile heights.

BACKGROUND OF THE INVENTION

In the tufting of carpets and other, similar articles, there is considerable emphasis placed upon development of new, more eye-catching patterns in order to try to keep up with changing consumer tastes and increased competition in the marketplace. In particular, there has been emphasis over the years on the formation of carpets that replicate the look and feel of fabrics formed on a loom. With the introduction of computer controls for tufting machines such as disclosed in the U.S. Pat. No. 4,867,080, greater precision and variety in designing and producing tufted pattern carpets, as well as enhanced production speeds, have been possible. In addition, computerized design centers have been developed to help designers design and create wider varieties of patterns, with requirements such as yarn feeds, pile heights, etc. being automatically calculated and generated by the design center computer. Accordingly, it can be seen that a need exists for systems and methods of forming tufted fabrics, such as carpets, having new designs incorporating a variety of pattern effects.

SUMMARY OF THE INVENTION

Briefly described, the present invention generally relates to a tufting machine and method of forming sculptured, multiple pile height patterned tufted articles in which the placement and pile height of tufts of yarns or stitches formed in a backing can be controlled with enhanced selectivity so as to enable formation of patterned tufted articles, such as carpets, having a variety of pattern effects and/or colors, including the formation of tufted articles with sculptured free-flowing multi-color and multi-pile height patterns, as well as with woven or loom formed appearances. The tufting machine of the present invention typically will include a control system for controlling the operative elements of the tufting machine to form desired input, programmed, scanned and/or designed patterns. Such patterns can include various pattern effects, including having multiple, varied or different pile heights, cut and/or loop pile tufts in the same and/or varying tuft rows, and other textured effects, as well as the placement of various color and/or type yarns to be visible at selected locations and pile heights across the backing, with the resultant tufted article being provided with a density of retained and/or visible colors/stitches per inch that substantially matches a desired or prescribed pattern density or stitches per inch for the pattern being formed/tufted.

The tufting machine will include one or more needle bars having a series of needles mounted therealong, with a tufting zone defined along the path of reciprocation of the needles. A backing material is fed through the tufting zone and tufts of yarns introduced therein as the needles are reciprocated into and out of the backing material. A shift mechanism further can be provided for shifting the needle bar(s) transversely across the tufting zone, and multiple shift mechanisms can be utilized where the tufting machine includes more than one shifting needle bar. The shift mechanism(s) will be operable in response to control instructions from the control system and can comprise servo motor controlled shifters, one or more cams, or other shifters, such as a "SmartStep" shift mechanism as manufactured by Card-Monroe Corp., for stepping or shifting the needle bar(s) transversely across the backing in accordance with programmed and/or designed pattern shift steps for a pattern being tufted.

Additionally, a gauge part assembly, which can include cut-pile hooks, loop pile loopers, level cut loopers or hooks, cut/loop hooks having biased clips attached thereto and/or combinations of these and other gauge parts, generally will be provided below the tufting zone. The gauge parts are reciprocated into engagement with the needles as the needles penetrate the backing material to pick loops of yarns therefrom. In one embodiment, cut pile hooks can be used. In other embodiments, a series of the level cut loop loopers can be used, each having movable clips that can be individually controlled based on the pattern stitch being formed and/or shift profile step, so as to be selectively actuated for each stitch according to whether the loops of yarn being formed thereby are to be released from or retention thereof along their level cut loop loopers blocked, such as to form loop pile tufts, or will be retained on the level cut loop loopers and cut to form a cut pile tuft. In still further embodiments, other configurations and/or combinations of loop pile loopers, cut pile hooks, cut/loop hooks and/or level cut loop loopers also can be used.

A needle plate further generally can be mounted along the tufting zone, with a series of reed fingers defining spaces or gaps through which the needles are reciprocated. The needle plate can include a backing support mounted thereon, formed or otherwise integrated with the needle plate, so that the backing material passes thereover as it is fed through the tufting zone. The backing support can be formed in sections or modules each of which can include a spring plate or biasing portion mounted on a base or spacer portion, which can be changeable as needed to locate the spring plate at a selected height or elevation with respect to the needle plate. Each spring plate further generally will comprise a flexible, resilient material, and in one embodiment, can be formed as an elongated plate having a base and a series of forwardly projecting fingers or spring elements. The backing support will tend to raise and maintain and/or bias the backing material toward an elevated or first position above the needle plate by a desired pile differential or bias distance. As the backing passes thereover, the tufts of yarns formed in the backing thus can be formed at a pile height that can include or be increased by an amount approximately equivalent to the pile height differential, spring or bias distance provided by the movement of the backing over the backing support plate.

The yarns fed to the needles can be selectively controlled so as to slow, back-rob, pull-back or otherwise limit the amount of the yarns fed to the needles for selected stitches or tufts, so as to result in a tightening or pulling of the loops of these yarns against the gauge parts, sufficient to create a tension force and/or pulling of the yarns taut. This tension created in the selected yarns in turn will pull and draw the backing against the backing support plate and the bias or spring force of the backing support. As the yarn tension is increased sufficient to overcome the resiliency or biasing/spring force of the spring plate, the spring plate of the backing support or at least the fingers or portions thereof can flex or bend, allowing the backing material to move or be pulled toward lowered positions closer to the needle plate, enabling further variation in the pile height of the tufts being formed by control of the yarn feed and the tension applied by the yarns against the backing in opposition/relation to the predetermined or selected pile differential and opposing spring or biasing force/resiliency provided by the backing support.

The tufting machine further generally will include at least one yarn feed mechanism or pattern attachment for controlling the feeding of the yarns to their respective needles. Such a pattern yarn feed pattern attachment or mechanism can include various roll, scroll, servo-scroll, single end, or double end yarn feed attachments, such as, for example, a Yarntronics™ or Infinity IIE™ yarn feed attachment as manufactured by Card-Monroe Corp. Other types of yarn feed control mechanisms also can be used. The at least one yarn feed mechanism or pattern attachment can be operated to selectively control the feeding of the yarns to their selected needles according to the pattern instructions for forming tufts of yarns, including tufts having varying pile heights, to create the desired carpet pattern appearance. For example, by controlling the yarn feed to selected needles so that the loops thereof engaged by the gauge parts are pulled thereagainst sufficient to create a desired tension force can be applied to the backing moving through the tufting zone, in opposition to the spring or biasing force provided by the backing support, the backing material can be caused to be drawn or pulled low and/or taut against the backing support, without being pulled through the needle plate. Cut and/or cut and loop tufts of yarns of different, varying pile heights thus can be formed by control of the yarn feed and tension applied thereby to create various sculptured pattern or high/low effects, including providing enhanced control of the formation/appearance of transitions therebetween.

In other embodiments, the control system can further comprise or operate with a stitch distribution control system, such as disclosed in U.S. Pat. No. 8,359,989 (the disclosure of which is incorporated by reference as if set forth fully herein), and can control the at least one yarn feed mechanism such that the yarns to be shown on the face or surface of the tufted article generally can be fed in amounts sufficient to form tufts of desired heights while the non-appearing yarns, which are not to be shown in the tufted field, will be back-robbed or otherwise pulled sufficiently low and/or out of the backing so as to avoid creation of undesired gaps or spaces between and/or minimize interference with the face or retained, visible tufts of yarns of the pattern. For each pixel or stitch location of the pattern, a series of yarns generally will be presented, and yarns not selected for appearance at such pixel or stitch location can be pulled back and/or removed. Thus, only the desired or selected yarns/colors to be placed at a particular stitch location or pixel typically will be retained at such stitch location or pixel, while the remaining yarns/colors will be hidden in the pattern fields being sewn at that time, including pulling the yarns out of the backing so as to float on the surface of the backing material. The control system further will control the operation of the shift mechanism(s) and yarn feed mechanism(s) according to the instructions for the pattern being formed.

The formation of tufts of yarn in the backing further can be controlled so as to form a greater number of stitches per inch in the backing than what is needed or called for in the pattern, i.e., at increased or denser effective or operative process stitch rates, with non-selected or non-retained tufts or stitches being removed or pulled so low as to avoid creating and/or occupying a gap or space at which a selected color or stitch/tuft of yarn of the pattern is to be retained, so as to provide for desired placement of selected types or colors of yarns, at defined stitch locations or pixels of the pattern being formed and with a substantially true pattern density, and which further can be formed at selected, varying pile heights, including control of transitions and/or other sculptured effects by control of the yarn feed in conjunction with the backing support.

Various objects, features and advantages of the present invention will become apparent to those skilled in the art upon a review of the following detailed description when taken in conjunction with the accompanying drawings.

Figure 1:
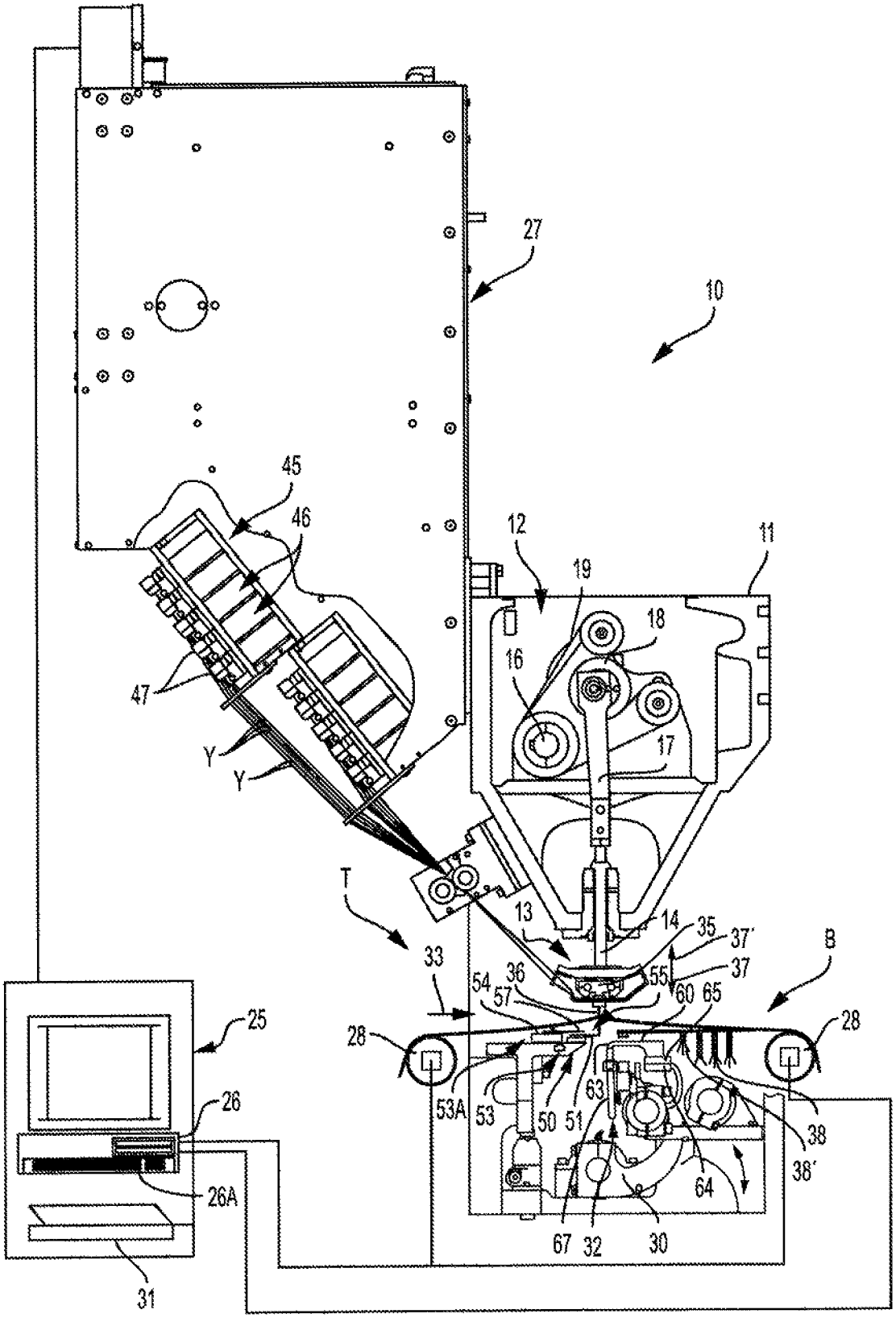
FIG. 1 is a side elevational view of one example embodiment of a tufting machine for forming sculptured multiple pile height patterned tufted articles in accordance with the principles of the present invention.

Those skilled in the art will appreciate and understand that, according to common practice, the various features of the drawings discussed below are not necessarily drawn to scale, and that the dimensions of various features and elements of the drawings may be expanded or reduced to more clearly illustrate the embodiments of the present invention described herein.

DETAILED DESCRIPTION OF THE INVENTION

Referring now to the drawings in which like numerals indicate like parts throughout the several views, in accordance with example embodiments of the system and method for forming sculptured patterned tufted articles according to the principles of the present invention, as generally illustrated in FIGS. 1-4B, embodiments of a tufting machine 10 is provided for forming or tufting stitches or tufts of yarns Y, at desired locations in a backing material B. Such tufts or stitches can be formed with a sculptured, multi-pile height tufted appearance, and further can be placed with enhanced selectivity, for formation of other varying or free-flowing pattern effects. For example, the tufted article can be formed with cut pile tufts, loop pile tufts, and/or combinations of cut and loop pile tufts, including such tufts being formed in the same tuft rows, with the tufts formed at varying pile heights to provide sculptured looks, and formation of multi-color patterns of various geometric and/or free-flowing designs. Additionally, it will be understood that various numbers of different type and/or color yarns (i.e., two color, three color, five color, six color, etc.), can be used to form the sculptured, multiple pile height patterned tufted articles according to the principles of the present invention.

Figure 2:
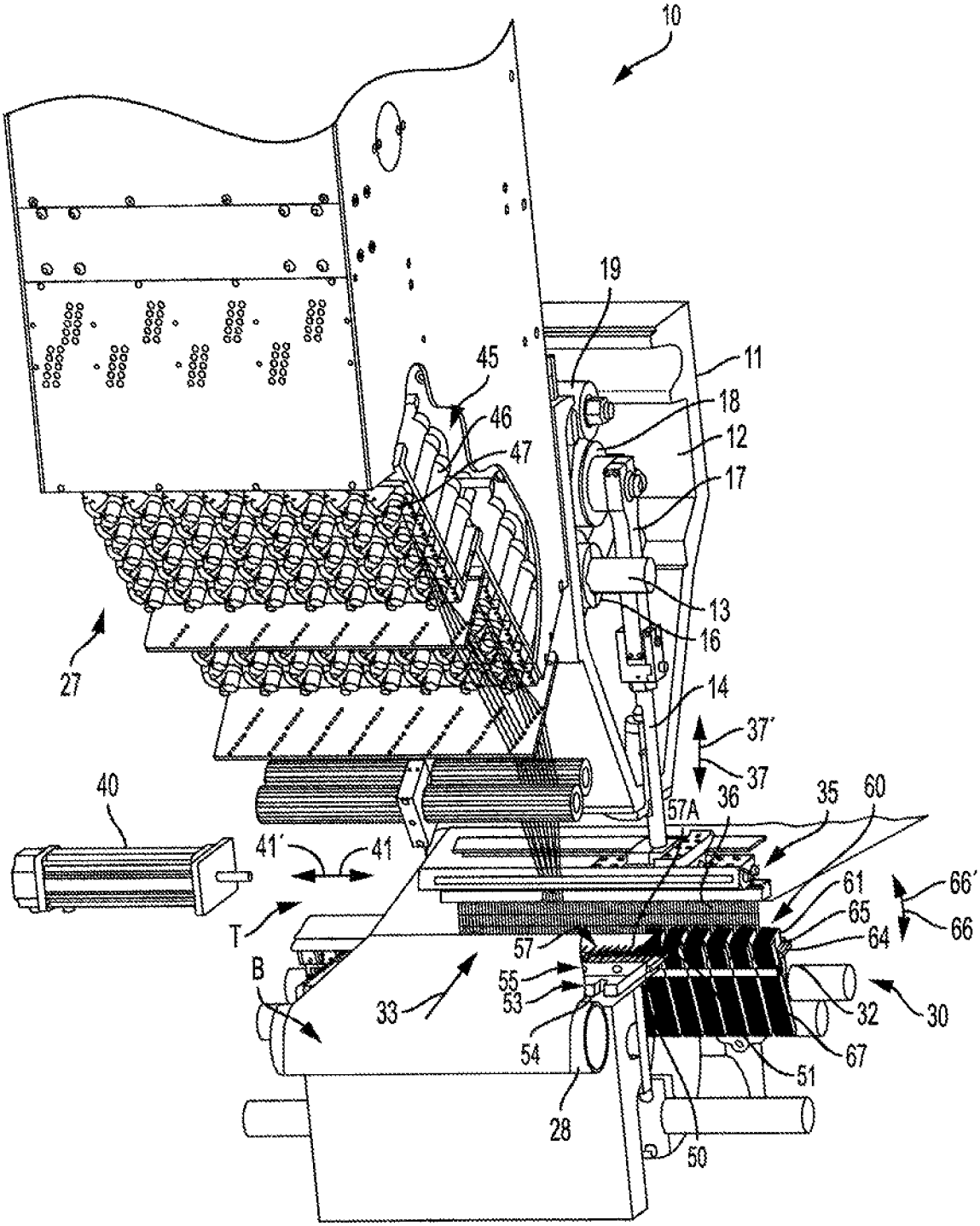
FIG. 2 is a perspective illustration of the tufting machine of FIG. 1.
Figure 3A:
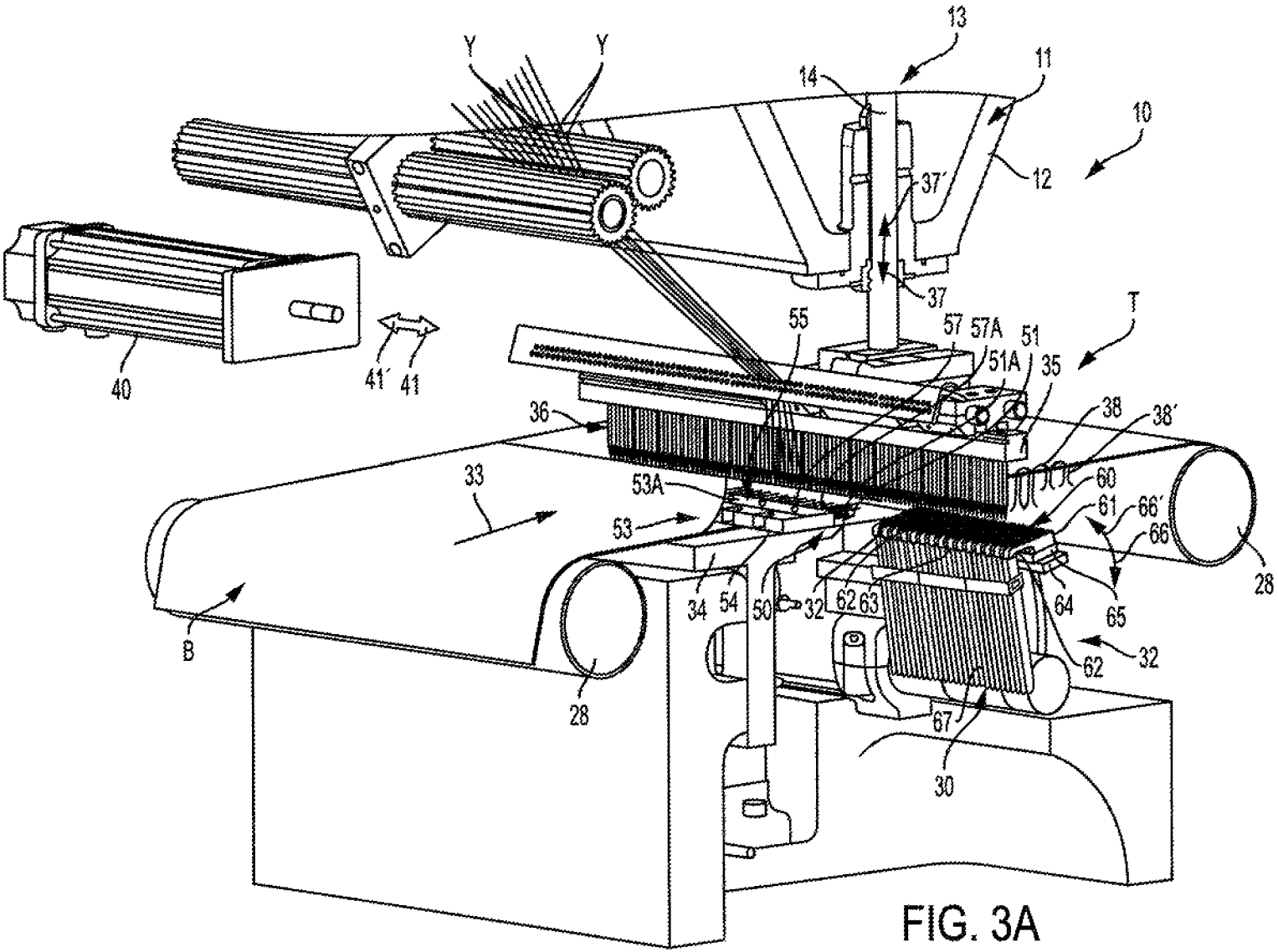
FIGS. 3A and 3B are perspective illustrations of one embodiment of a tufting machine including a series of cut pile hooks for forming multi-pile height sculptured cut pile articles in accordance with the principles of the present invention.
Figure 3B:
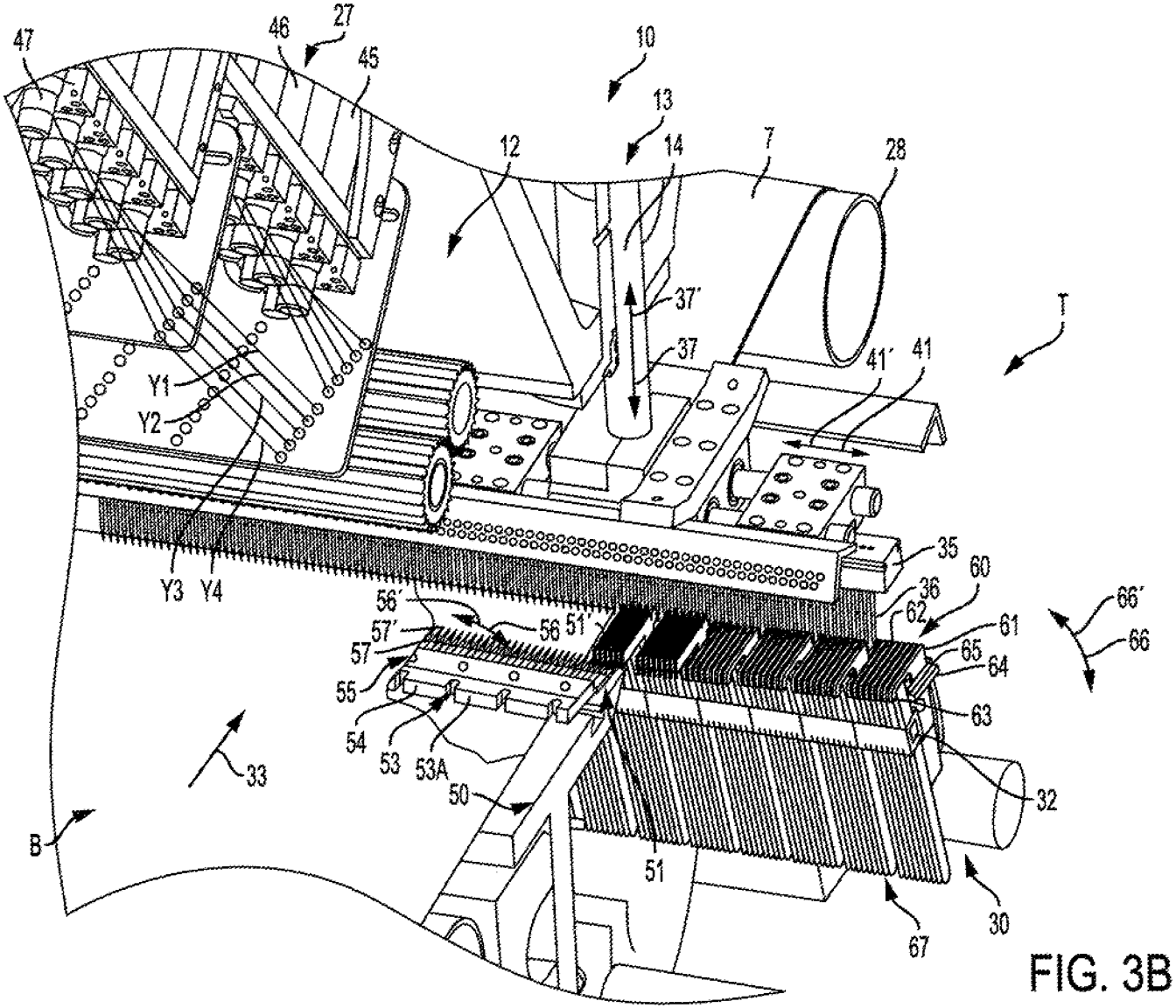

As generally illustrated in FIG. 1, in one embodiment, the tufting machine 10 will include a frame 11, which can include a head or upper portion 12 housing a needle bar drive mechanism 13 and defining a tufting zone T. The needle bar drive mechanism 13 (FIGS. 1 and 2) typically includes a series of push rods 14 that can be connected to a needle bar drive 16 (such as a gear box/assembly as shown in FIGS. 1-2) or similar mechanism, by connector rods 17. The gear box drive 16 in turn is connected to and driven off a main drive shaft 18 (FIG. 1) for the tufting machine, for example, by one or more drive belts or drive chains 19, with the main drive shaft 18 itself being driven by a motor such as a servo motor. Alternatively, the push rods 14 of the needle bar drive mechanism 13 can be directly connected via connector rods 17 to the main drive shaft 18 so as to be driven directly off the main drive shaft, or by an independent drive system (not shown).

An encoder additionally can be provided for monitoring the rotation of the main drive shaft and reporting the position of the main drive shaft to a control system 25 (FIG. 1) controlling the operation of the tufting machine 10. The control system 25 generally will comprise a tufting machine control including a computer/processor or system controller 26 with an operator interface 26A through which the operator can input patterns, make adjustments, etc. In some embodiments, the control system 25 can comprise or include a stitch distribution control system such as disclosed in U.S. Pat. No. 8,359,989, the disclosure of which is incorporated by reference as if set forth fully herein, with the controller 26 further including programming for control methodology for forming tufted patterns, including sculptured patterns having tufts formed at multiple pile heights, as well as with various color/stitch placement controlled patterns such as disclosed in U.S. Pat. No. 8,359,989.

The control system 25 generally will include programming enabling the monitoring and control of the operative elements of the tufting machine 10, such as the needle bar drive mechanism 13, yarn feed attachments 27, backing feed rolls 28, the main drive shaft 18, a needle bar shift mechanism 40 (FIGS. 2, 3A and 4B) and a gauge part assembly 30 mounted beneath the tufting zone T of the tufting machine in accordance with the calculated/determined pattern instructions developed by the stitch distribution control system, as discussed more fully below. The control system 25 (FIG. 1) further can receive and execute or store pattern information in memory storage of the system controller 26. In response to developed/programmed pattern instructions, the control system 25 will control the operative elements of the tufting machine 10 in order to form the desired tufted patterns in the backing material B as the backing material is passed through the tufting zone T in the direction of arrow 33 by the backing feed rolls 28, as indicated in FIGS. 1-4B.

In some embodiments, the system controller 26 of the control system 25 generally can be programmed with instructions for forming one or more desired patterns for one or more tufted articles, including a series of pattern steps, which steps can be created or calculated manually or through the use of design centers or design software as understood by those skilled in the art. Alternatively, the controller 26 can include image recognition software to enable scanned and/or designed pattern images, such as designed patterns, including pile heights and other characteristics such as placement of loop pile and cut pile tufts in the pattern shown by, for example, different colors or similar markers or indicators, as well as photographs, drawings and other images, to be input, recognized and processed by the control system, and a scanner or other imaging device 31 (FIG. 1). The control system can recognize and identify various pattern characteristics, including colors and/or difference in texture of a designed pattern image indicative of texture effects such as placement or location of loop and/or cut pile tufts, and can assign selected yarns thereto.

Additionally, in embodiments such as where the system control 25 operates with or comprises or includes functionality of a stitch distribution control system, as disclosed in U.S. Pat. No. 8,359,989, the control system also can be provided with software/programming to read and recognize colors of an input scanned pattern, and can assign supply positions for the yarns being supplied from a supply creel to various ones of the needles based on the thread-up sequence of the needles of the needle bar so as to optimize the supplies of the various color yarns in the creel for the best use thereof, to form recognized pattern fields from pattern images. The system control further can create pattern fields or mapping of the pattern, including a series of pattern pixels or tuft/stitch placement locations identifying the spaces or locations at which the various color yarns and/or cut/loop pile tufts will be selectively placed to form the imaged pattern. The desired pattern density, i.e., the desired number of stitches per inch to appear on the face of the finished patterned tufted article, also can be analyzed and an effective or operative process stitch rate for the pattern calculated to achieve the appearance of the desired fabric stitch rate of the scanned and/or designed pattern.

The control system 25 of the invention further can include programming to receive, determine and/or execute various shift or cam profiles, or can calculate a proposed shift profile based on the scanned or input designed pattern image. Effectively, in one embodiment, a designed pattern image, photograph, drawing, etc., can be scanned, loaded or otherwise input directly at the tufting machine, and the control system can read, recognize and calculate the pattern steps/parameters, including control of yarn feed, control of backing movement and/or needle reciprocation to form tufts in the backing at an effective stitch rate to achieve a desired pattern density, a cam/shift profile, and arrangement of yarns to match the scanned and/or designed pattern image, and can thereafter control the operation of the tufting machine to form this scanned and/or designed pattern. An operator additionally can select a desired cam profile or modify the calculated shift profile, such as by indicating whether the pattern is to have 2, 3, 4, 5 or more colors, or a desired number of pattern repeats, and/or can manually calculate, input and/or adjust or change the creel assignments, shift profiles and/or a color mapping created by the control system as needed via a manual override control/programming.

As indicated in FIGS. 1-4B, the tufting machine 10 further will include one or more needle bars 35 attached to and driven by the push rods 14. The needle bar(s) 35 move a series of needles 36 in a reciprocating motion (shown by arrows 37/37') into and out of the backing material B, so as to carry or insert the yarns Y into the backing. In some embodiments, the needles can be arranged in a single in-line row along one or two needle bars, while in other embodiments, the needles 35 can be mounted in a staggered arrangement, with offset rows of needles spaced transversely along the length of one or a pair of needle bar(s) and across the tufting zone of the tufting machine. The needle bar(s) 35 further can be shiftable transversely across the width of the backing material. While only a single needle bar 35, with an inline row of needles 36 arranged therealong is shown in the figures, it will be understood by those skilled in the art that additional arrangements of dual and single needle bars having spaced rows of needles 36 that can be arranged in-line or in a staggered or offset configuration, and which further can be shifted, also can be utilized in the tufting machine 10 incorporating the system according to the present invention.

As the needles are reciprocated in the direction of arrows 37 and 37' (FIG. 2), they penetrate into and out of the backing material B, carrying the yarns Y therewith to create and/or place loops L of yarns Y in the backing material and are engaged by gauge parts 32 of the gauge part assembly 30 for forming cut pile tufts 38/38' and/or cut and loop pile tufts 38/38'-39/39' (FIGS. 4A-4B) in the backing material. Additionally, as illustrated in the embodiments shown in FIGS. 2, 3A and 4B, in some embodiments a shift mechanism 40 can be linked to the needle bar 35 (or needle bars) for shifting the needle bar in the direction of arrows 41 and 41', transversely across the tufting zone according to calculated or computed pattern instructions. The shift mechanism 40 can include a Smart Step™ type shifter as manufactured by Card-Monroe Corp., or alternatively can include various other types of shift mechanisms including servo-motor or hydraulically controlled shifters, and/or pattern cam shifters as are conventionally used. Additional shift mechanisms including backing material or jute shifters, operable separately or in conjunction with a needle bar shifter for shifting the backing material laterally with respect to the needles also can be used.

Figure 4A:
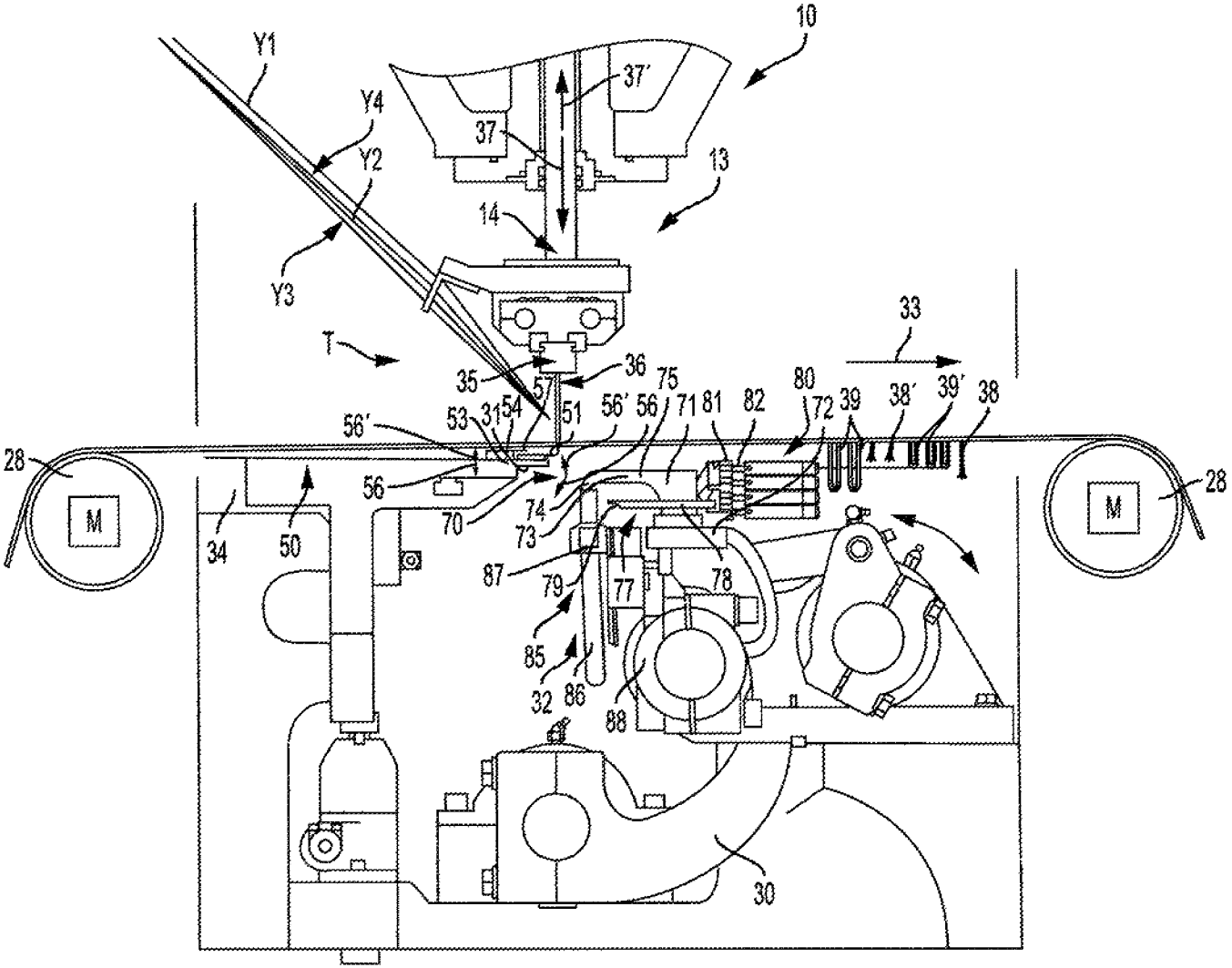
FIG. 4A is a side elevational view of an additional embodiment of a tufting machine for forming sculptured, multiple pile height patterned tufted articles including a series of level cut loop loopers.
Figure 4B:
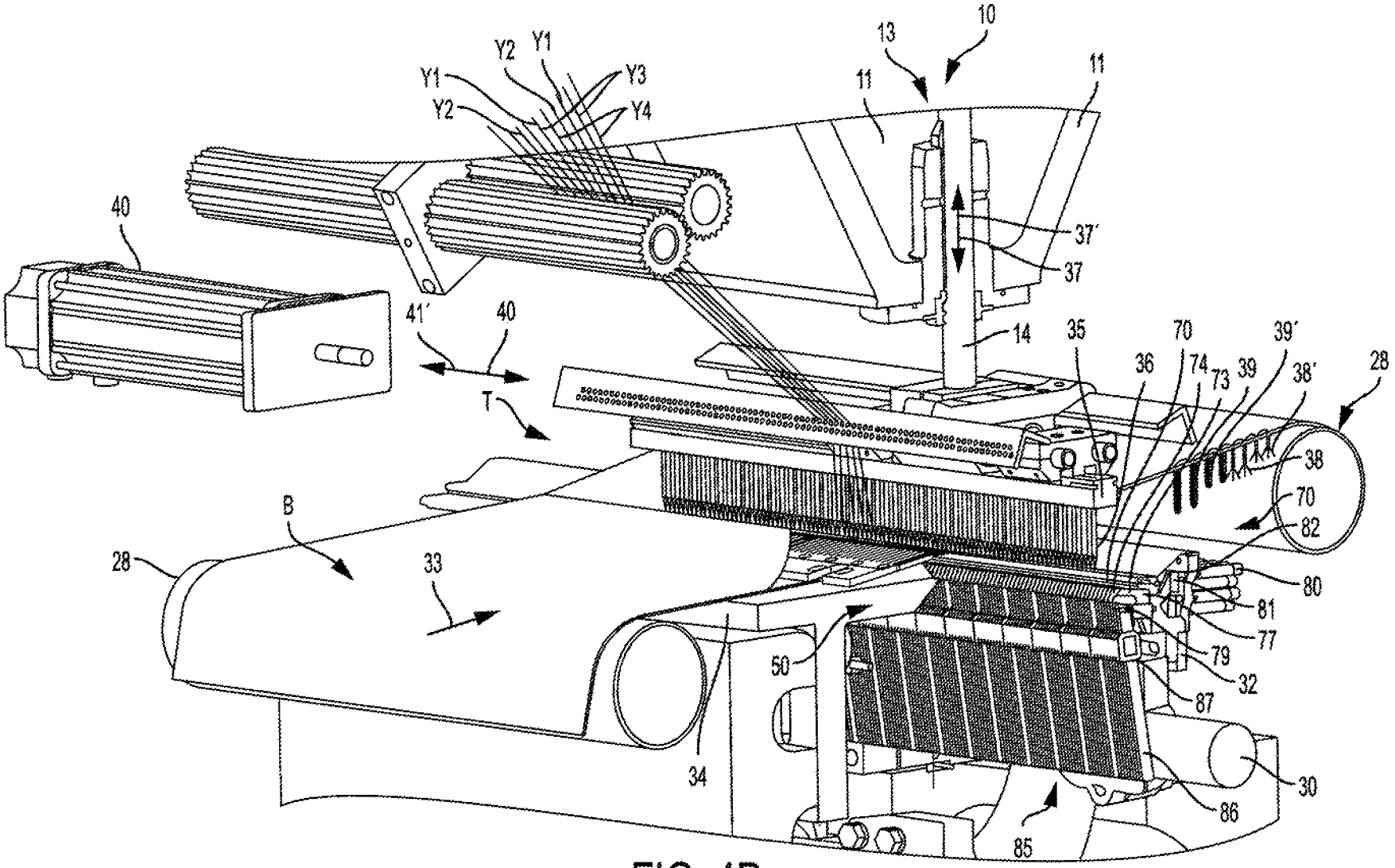
FIG. 4B is a perspective illustration of the tufting machine of FIG. 4A.

As additionally illustrated in FIGS. 1-2, one or more yarn feed mechanisms or attachments 27 can be mounted to the frame 11 of the tufting machine 10 for controlling the feeding of the yarns Y to each of the needles during operation of the tufting machine. For example, as indicated in FIGS. 4A-4B, a series of different type or color yarns (Y1-Y4) can be fed in a selected thread-up sequence or series (e.g., ABCD) to each of the needles, with the thread-up sequences being determined or selected based upon a pattern being run. There are a variety of yarn feed attachments that can be utilized with the stitch distribution control system of the present invention for controlling the feeding of the different yarns Y to various ones of the needles 36. The pattern yarn feed attachments or mechanisms 27 (FIG. 1) can comprise conventional yarn feed/drive mechanisms such as roll or scroll pattern attachments having a series of rolls extending at least partially along the tufting machine and driven by motors under direction of the control system 25 for controlling the feeding of the yarns across the tufting machine to form pattern repeats and/or multiple pile heights and/or other texture effects across the width of the backing material. Such yarn feed mechanisms or attachments can include Quick Thread™, Enhanced Graphics™, and/or Multi Pile Height Scroll yarn feed controls/attachments as manufactured by Card-Monroe Corp. Alternatively, other types of pattern yarn feed attachments can be used which have multiple yarn feed drives 45, as indicated in FIGS. 1-2, each including a motor 46 and a feed roll 47, for controlling the feeding of specific sets of repeats of yarns to selected needles, including the use of individual yarn feed rolls or drives 45 for controlling the feeding of single yarns (or ends) or pairs (or more) of yarns to each of the needles 36, such as single end/servo-scroll attachments, including Infinity™ and Infinity IIE™ systems as manufactured by Card-Monroe Corp.

For example, U.S. Pat. Nos. 6,009,818; 5,983,815; 7,096,806, and 8,776,703 disclose pattern yarn feed mechanisms or attachments for controlling feeding or distribution of yarns to the needles of a tufting machine. U.S. Pat. No. 5,979,344 further discloses a precision drive system for driving various operative elements of the tufting machine. All of these systems can be utilized with the present invention and are incorporated herein by reference in their entireties. Thus, while in FIG. 1 a single or double end type yarn feed mechanism 27 as shown, it also will be understood by those skilled in the art that the pattern yarn feed mechanisms utilized to control the yarn feed can include single or double end yarn feed controls, scroll, roll, and/or similar attachments, and/or various combinations thereof, and further can be mounted along one or both sides of the tufting machine. Still further, the control system 25 can perform yarn feed compensation and/or yarn feed modeling to help control and reduce or minimize the amounts of non-retained/non-appearing The yarn feed attachment can be controlled to selectively feed the yarns to their respective needles, to enable control of the pile height at which the tufts are formed. In addition, the surface or face yarns or tufts that are to appear on the face of the tufted article can be controlled so as to be fed in amounts sufficient to form such desired cut/loop tufts at desired or prescribed pile heights, while the non-appearing yarns that are to be hidden in particular color and/or texture fields of the pattern will be backrobbed and/or pulled low or out of the backing material to an extent to avoid creating an undesired space or gap between the retained or face yarns. In one embodiment, each color or type yarn that can be placed/tufted at each pixel or stitch location generally can be presented to such pixel or stitch location for tufting, with only the yarn(s) to be shown or appearing at the pixel or stitch location being retained and formed at a desired pile height. Thus, for a 4 color pattern, for example, each of the 4 color yarns A, B, C and D that can be tufted at a particular pixel or location can be presented to such pixel with only the selected yarn or yarns of the pattern, e.g., the "A" yarn, being retained, while the remaining, non-selected yarns, B-D are presented and are pulled back and/or removed from the pixels or stitch locations. Accordingly, any time a yarn is presented to a pixel or stitch location, if the yarn is to be retained or appear in the pixel or stitch location, the yarn feed 27 can be controlled to feed an amount of yarn so as to form a tuft of yarn at the pixel or stitch location. If the yarn presented is not to be retained or appearing in the pixel or stitch location, it can be pulled back and/or removed. If no yarns are selected for insertion at a particular pixel or stitch location, the needle bar further can be shifted to jump or otherwise skip or bypass presentation of the needles to that pixel or stitch location.

Figure 5A:
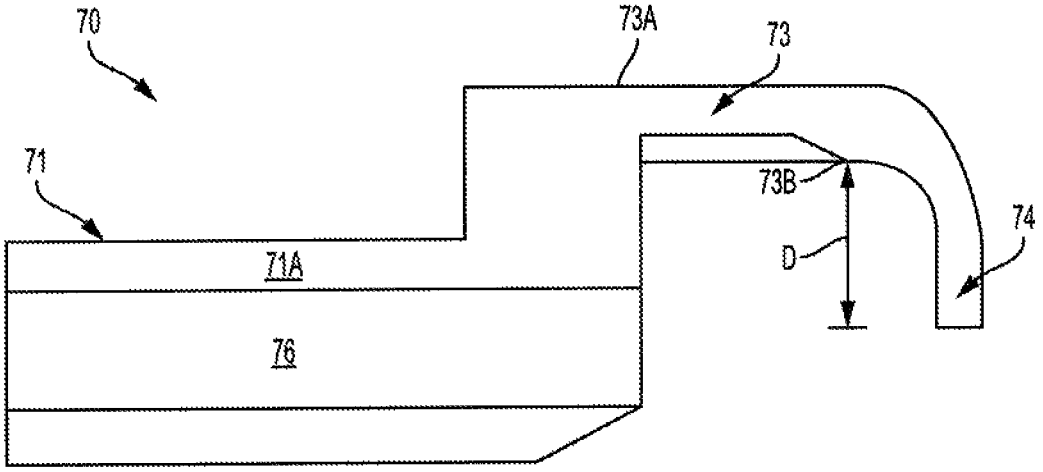
FIG. 5A is a side elevational view of a level cut loop looper for use in the tufting machine for forming sculptured, multiple pile height patterned tufted articles as illustrated in FIGS. 4A-4B.
Figure 5B:
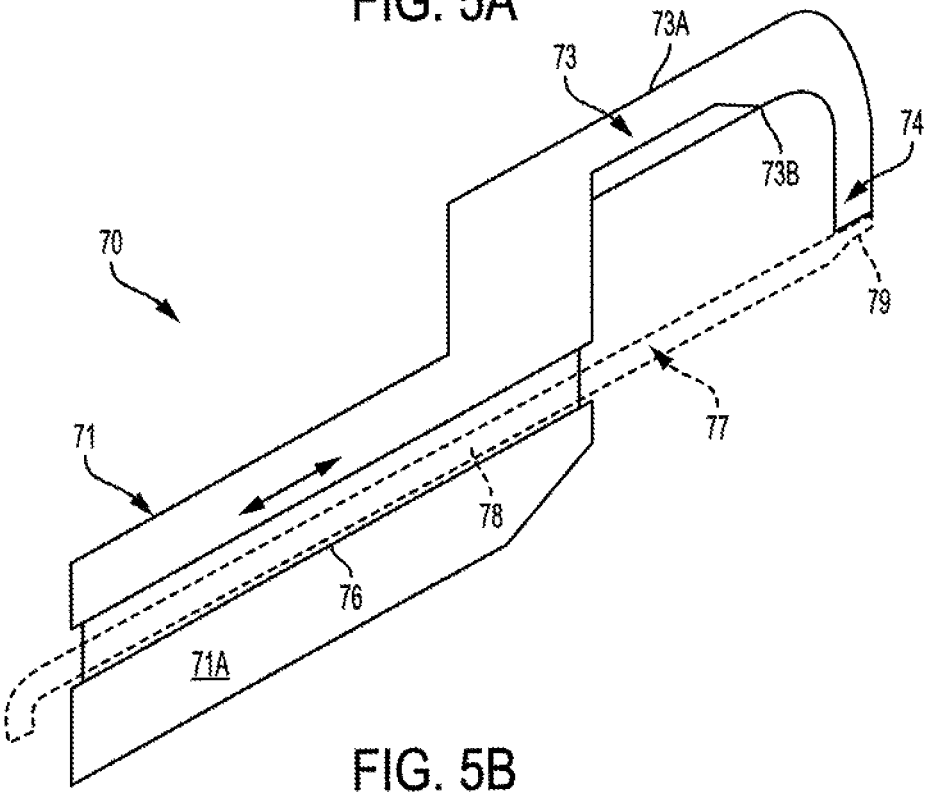
FIG. 5B is a perspective illustration of the level cut loop looper of FIG. 5A.

In another embodiment, as indicated in FIGS. 4A-5B and 8A-8B, the gauge parts 32 of the gauge part assembly 30 can include a series of level cut loop loopers 70, each of which generally can include a looper body 71, the rear portion or shank portion 71A of which can be received in a support or hook block 72, and a longitudinally extending throat portion 73, terminating in a hooked front or bill portion 74 (FIGS. 5A-5B) that extends downwardly therefrom. As shown in FIGS. 5A and 5B, each of the level cut loop loopers 70 further can include an expanded or extended throat portion 73, which can be extended or located at an increased elevation or height with respect to the shank portion 71A of the body of the level cut loop looper, and with the hook or bill portion 74 thereof extending further downwardly by an increased distance as indicated by "D" in FIG. 5A. For example, the throat portion of each level cut loop looper can have an upper edge 73A that is approximately 0.25"-0.275" above the shank portion of the body, and a lower or bottom edge 73B of the throat portion that can be located or spaced approximately 0.10"-0.15" above the shank portion, and with the hooked and/or bill portion 74 extending approximately 0.4-0.75" therebelow. Other, greater or lesser dimensions also can be provided.

Figure 8A:
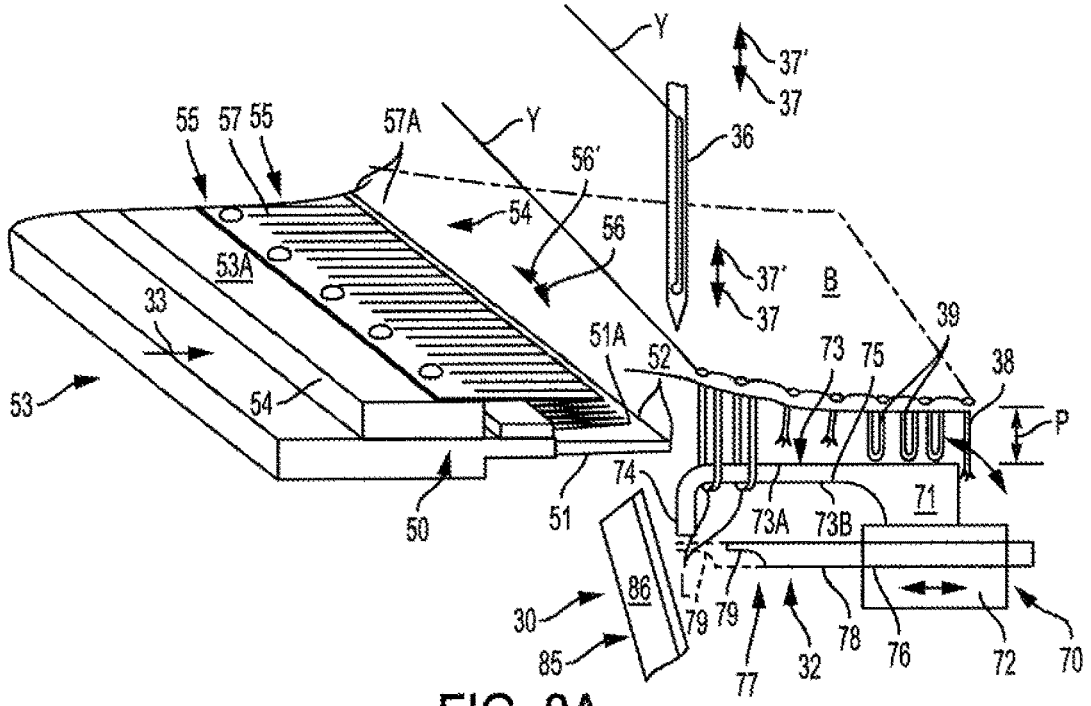
FIG. 8A is perspective illustration of a portion of the needle plate and backing support for forming tufts of varying pile heights in accordance with the principles of the present invention.
Figure 8B:
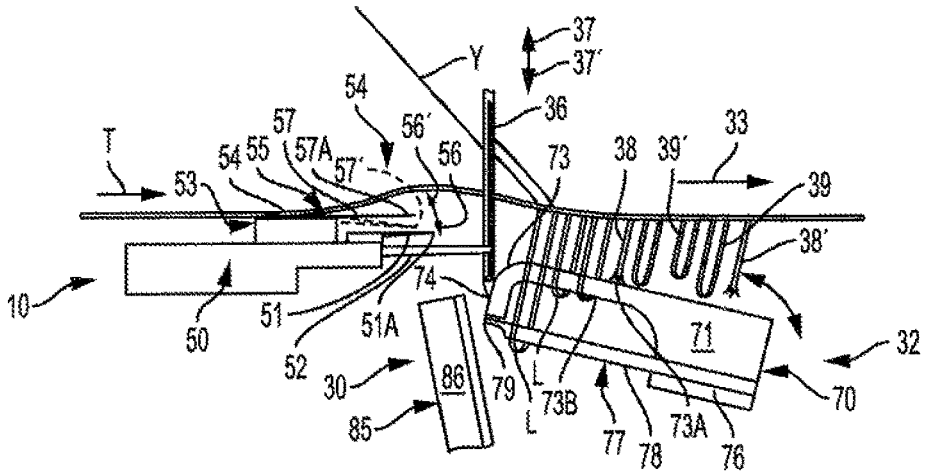
FIG. 8B is a side elevational view schematically illustrating the formation of cut and loop pile tufts of varying pile heights to form the sculptured, multiple pile height patterned tufted articles in accordance with the principles of the present invention.

The clips 77 of selected level cut loop loopers 70 can be moved forwardly or downwardly by operation of their associated actuators 80 to move the clips from a recessed or retracted position to an extended position, illustrated in FIGS. 4A and &A-8B, with the front end 79 of each selected clip 77 projecting forwardly adjacent the tip of front end or bill 74 of its level cut loop looper. With the clips in their extended positions, as level cut loop loopers reciprocate forwardly, the needles are engaged by the level cut loop loopers 70, and loops L of yarns are picked from the needles 36 and are generally blocked or prevented from being retained on the throats of the level cut loop loopers, behind the hooked front ends or bills thereof, as illustrated in FIGS. 8A-8B. These loops of yarn thereafter can be pulled from the level cut loop loopers by the return stroke or reciprocation of the level cut loop loopers. As a result, loop pile tufts can be formed in the backing material while the clips are in their retracted positions.

Alternatively, to form cut pile tufts 38', the actuators 79 for the selected level cut loop loopers 70 can be engaged/disengaged or otherwise caused to move their clips 77 to their retracted positions, so as to create a gap or space between the front end or tip of the front bill portion 74 of the level cut loop loopers, and their clips, so as to substantially avoid engagement or interference with the pick-up and capture or retention of the loops of yarns from the needles by the level cut loop loopers. As a result, as indicated in FIG. 8B, the loops L of yarns Y picked from the needles can be trapped and retained along the throat portions 73 of the level cut loop loopers for cutting to selectively form cut pile tufts in the backing material.

As further illustrated in FIGS. 4A-4B, a series of knife assemblies 85 typically are provided adjacent the level cut loopers 70. Each knife assembly 85 generally includes a knife or cutting blade 86 mounted within the holder 87 and can be connected to a reciprocating drive mechanism 88. The knives are reciprocated into engagement with the level cut loop loopers 60 (FIGS. 8A and 8B) so as to cut any loops of yarns selectively captured thereon in order to form cut pile tufts 38 in the backing material as the backing material B is passed through the tufting zone in the direction of arrow 33.

In operation of the system and method for forming sculptured or multi-pile height tufted articles, including both cut and/or loop pile tufts of yarns being tufted with multiple or varying pile heights, as indicated in FIGS. 8A and 8B, as the needles penetrate the backing material, they are engaged by the level cut loop loopers 70 so as to pick and pull loops L of yarns Y therefrom. The clips 77 of selected ones of the level cut loop loopers 70 can be actuated in accordance with the pattern instructions so as to move the clips of the selected level cut loop loopers between their retracted and extended positions. In their retracted positions, as indicated in FIG. 8A, the level cut loop loopers 70 will be permitted to retain or capture loops L of yarns along the throat portions 73 thereof, which loops thereafter can be cut to form cut pile tufts 38. Alternatively, as indicated in FIG. 8B, for the selected level cut loop loopers 70 whose clips 77 are actuated and/or moved to their extended positions, with the front portions of the clips located adjacent the hooked front ends or bills 74 of the level cut loop loopers, retention of loops of yarns can be substantially blocked.

In addition, the yarns being fed to the needles 36 engaged by the level cut loop loopers 70 can be controlled so as to hold, slow, back-rob, pull, or otherwise limit the amount of the yarns being fed to selected ones of the needles sufficient to cause such yarns to be pulled tighter or substantially taut against the throat portions of the level cut loop loopers or against the clips of the level cut loop loopers. As a result of the tension created by the control of the yarn feed tightening or pulling the yarns substantially taut against the level cut loop loopers, the backing material correspondingly can be drawn or otherwise pulled tighter or substantially taut against the backing support 53. In response, the spring fingers 57 of the spring plate or biasing portion 55 of the backing support 53 (e.g., at least a portion thereof along the area of portion of the backing to which the selected, controlled yarns are applying a tension or pulling force) can bend, flex and/or move toward a lowered position, as indicated at 57' in FIG. 8B, in response to the tension or pulling force being applied thereagainst by the backing due to the tension created in/applied by the control of the feeding of the selected yarns increasing to an amount or extent sufficient to overcome the opposing resiliency or biasing or spring force applied by the spring fingers. The backing material accordingly will be drawn toward the needle plate so as to adjust or vary the pile height of the tufts 38/38' or 39/39' being formed therein. For example, the closer the backing material is drawn toward the needle plate, the lower the pile height of the tufts 38'/39' being formed. The yarn feed for loops of yarns that are not retained or which are released from engagement with the level cut loop loopers by operation of their clips further can be controlled to enable the formation of additionally varying pile height loop pile tufts 39/39', and/or to enable substantial burying of the ends of such loops of yarns as needed or desired in accordance with the pattern instructions. As further indicated in FIGS. 8A and 8B, for loops L of yarns that are captured and/or retained along the throat portions 73 of the level cut loop loopers 70, these loops thereafter can be cut by their associated knives 85 to form cut pile tufts 38/38'.

The amount of tension being applied by the selected, controlled yarns to the backing material by the control of the feeding of such yarns can be used to control movement of or an amount by which the backing material is pulled closer or remains further away from the needle plate due to the resiliency, biasing or spring force created by the spring plate 55 of the backing support, and/or the spring fingers 57 thereof, acting in opposition to this yarn feed tension, so as to correspondingly enable control of the formation of cut pile tufts 38/38' at varying pile heights. This resiliency or biasing force provided by the spring plate of the backing support further can help substantially minimize or avoid the pulling of the backing material between the reed fingers of the needle plate as a result of such yarn tension. In addition, the configuration of the level cut loop loopers further can assist in formation of cut pile tufts in which the formation of "J-tufts" or otherwise generally uneven height cut pile tufts can be substantially minimized, in order to enable a more consistent, controlled formation of both cut and loop pile tufts having desired, selected pile heights, including the formation of cut and loop pile tufts in the same longitudinal tuft rows. As a result, sculptured, multi-pile height tufted carpets or other fabrics can be formed which can include varying textured effects, including controlled transitioned between higher and lower pile tuft fields or areas, shading effects resulting from smaller pile height differences, and other pattern effects.

In additional embodiments, for forming sculptured, multi-pile tufted articles according to the system and method of the present invention, multiple different color and/or type yarns further can be used for forming patterns. For example, the system and method of the present invention can be incorporated in conjunction or operated with a stitch distribution control system or yarn color placement system such as disclosed and illustrated in U.S. Pat. Nos. 8,141,505, 8,359,987 and 8,776,703, the disclosures of which are incorporated by reference as if set forth fully herein. In such embodiments, the stitches or tufts of yarns being formed in the backing material further can be formed at an increased or higher actual operative or effective process stitch rate as compared to the fabric or pattern stitch rate that is desired or prescribed for the tufted pattern being formed. For example, if the pattern or fabric stitch rate or density of a pattern being formed calls for the tufted article to have an appearance of 8, 10, 12, etc., stitches per inch formed therein, and/or which are to be shown on its face, the actual, operative or effective number of stitches per inch formed during operation of the tufting machine will be greater than the desired or prescribed pattern or fabric stitch rate. Thus, the actual formation of stitches or tufts of yarns in the backing material will be accomplished at an increased operative process stitch rate, whereby effectively, a greater number of stitches per inch than required for the finished pattern will be formed in the backing material, with those stitches that are not desired to be shown or remaining in the face of the pattern being back-robbed, pulled out of the backing material, or sufficiently low to an extent so as to substantially avoid creation of undesired or unnecessary gaps or spaces between the retained or face yarns of the pattern (i.e., the tufts of yarns that are to remain visible or appear in the finished pattern of the tufted article).

In one example embodiment, the effective process stitch rate can be based upon or determined by increasing the fabric or pattern stitch rate of the pattern being formed approximately by a number of colors selected or being tufted in the pattern. For a pattern having a desired fabric or pattern stitch rate of about 10-12 stitches per inch, and which uses between 2-4 colors, the effective or operative process stitch rate (i.e., the rate at which stitches are actually formed in the backing material) can be approximately 18-20 stitches per inch up to approximately 40 stitches per inch. However, it further will be understood by those skilled in the art that additional variations of or adjustments to such an operative or effective process stitch rate run for a particular pattern can be made, depending upon yarn types and/or sizes and/or other factors. For example, if thicker, larger size or heavier yarns are used, the effective process stitch rate may be subject to additional variations as needed to account for the use of such larger yarns (e.g., for 4 color patterns, the effective process stitch rate can further vary, such as being run at about 25-38 stitches per inch, though further variations can be used as needed). Thus, where an operator selects ten to twelve stitches per inch as a desired pattern density or stitch rate, the stitch system may actually operate to form upwards of twenty to forty-eight or more stitches per inch, depending on the number of colors and/or types of yarns, even though visually, from the face of the finished tufted article, only the desired/selected ten to twelve stitches generally will appear.

Additionally, where a series of different colors are being tufted, the needles 36 of the needle bar 35 generally will be provided with a desired thread up, for example, for a four-color pattern an A, B, C, D thread up can be used for the needles. Alternatively, where 2 needle bars are used, the needles of each needle bar can be provided with alternating thread up sequences, i.e., an A/C thread up on the front needle bar, with the rear needle bar threaded with a B/D color thread up. In addition, the needles of such front and rear needle bars can be arranged in a staggered or offset alignment. The needle bar or needle bars further generally will be shifted by control of the needle bar shifter 40 (FIG. 2) in accordance with a shift profile for the pattern being formed, in conjunction with the control of the backing material and control of the yarn feed so as to effectively present each one of the colors (i.e., 2, 3, 4, 5, etc.) of yarns or each different type of yarn that could be sewn at a selected pattern pixel or tuft/stitch location to the cut pile hook or level cut loop looper hook by shifting of the needle bar transversely with respect to the backing material as the backing material is fed through the tufting zone.

For example, for a four color pattern, each of the one-four colors that can be sewn at a next pixel or stitch location, i.e., one, two, three, four, or no yarns can be presented at a selected pixel or stitch location, will be presented to a desired level cut loop looper or cut pile hook as the backing material is moved incrementally approximately ⅛th-1/40th of an inch per each shift motion or cam movement cycle. The level cut loop loopers or cut pile hooks will engage and form loops of yarns, with a desired yarn or yarns being retained for forming a selected tuft, while the remaining yarns generally can be pulled low or back robbed by control of the yarn feed mechanism(s), including pulling these non-retained yarns pulled out of the backing material so as to float along the backing material. Accordingly, each level cut loop looper or cut pile hook is given the ability to tuft any one, or potentially more than one (i.e., 2, 3, 4, 5, 6, etc.,) of the colors of the pattern, or possibly none of the colors presented to it, for each pattern pixel or tuft/stitch location associated therewith during each shift sequence and corresponding incremental movement of the backing material. As noted, if none of the different type or color yarns is to be tufted or placed at a particular tuft or stitch location or pixel, the yarn feed can be controlled to limit or otherwise control the yarns of the needles that could be presented at such stitch location or pixel to substantially pull back all of the yarns or otherwise prevent such yarns from being placed or appearing at that stitch location, and/or the needle bar additionally could be controlled so as to jump or otherwise bypass or skip presentation of the needles/yarns to that stitch location or pixel.

The feeding of the backing material B further can be controlled, i.e., by the stitch distribution control system in a variety of ways. For example, the tufting machine backing rolls 28 can be controlled to hold the backing material in place for a determined number of stitches or cycles of the needle bar, or can move the backing material incrementally per a desired number of stitches, i.e., insert one stitch and move 1/40th of an inch or run 4 stitches and move 1/10th of an inch for a pattern with four colors and an effective stitch rate of 40 stitches per inch. Still further, the incremental movement of the backing material can be varied or manipulated on a stitch-by-stitch basis with the average movement of all the stitches over a cycle substantially matching the calculated incremental movement of the operative or effective process stitch rate. For example, for a 4-color cycle, one stitch can be run at 1/80th of an inch, the next two at 1/40th of an inch, and the fourth at 1/20th of an inch, with the average incremental movement of the backing over the entire 4-stitch cycle averaging 1/40th of an inch, as needed, to achieve a desired stitch/color placement.

Alternatively, the number of stitches per cycle of the needle bar can be further manipulated, such as by the manual override function to manipulate/vary the movement of the backing material on a stitch-by-stitch basis, with the average movement of all the stitches over a cycle substantially matching the calculated incremental movement at the effective stitch rate, i.e., for a 4-color cycle, one stitch can be run at 1/80th of an inch, the next two at 1/40th of an inch, and the fourth at 1/20th of an inch, with the average incremental movement of the backing over the entire 4-stitch cycle averaging 1/40th of an inch, as needed, to achieve a desired stitch/color placement.

Figure 6A:
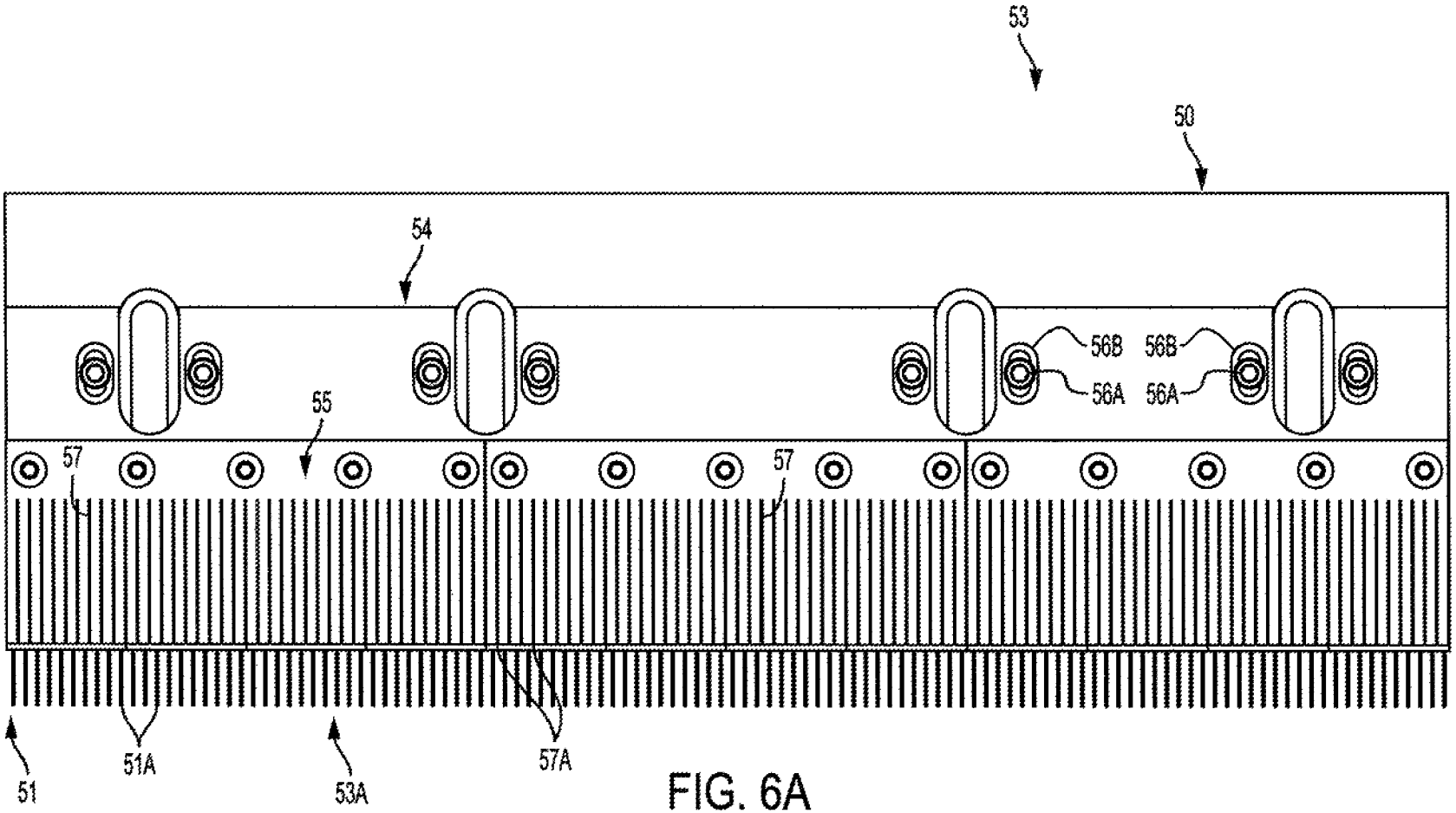
FIG. 6A is a plan view of one embodiment of the needle plate and backing support according to the principles of the present invention.
Figure 6B:
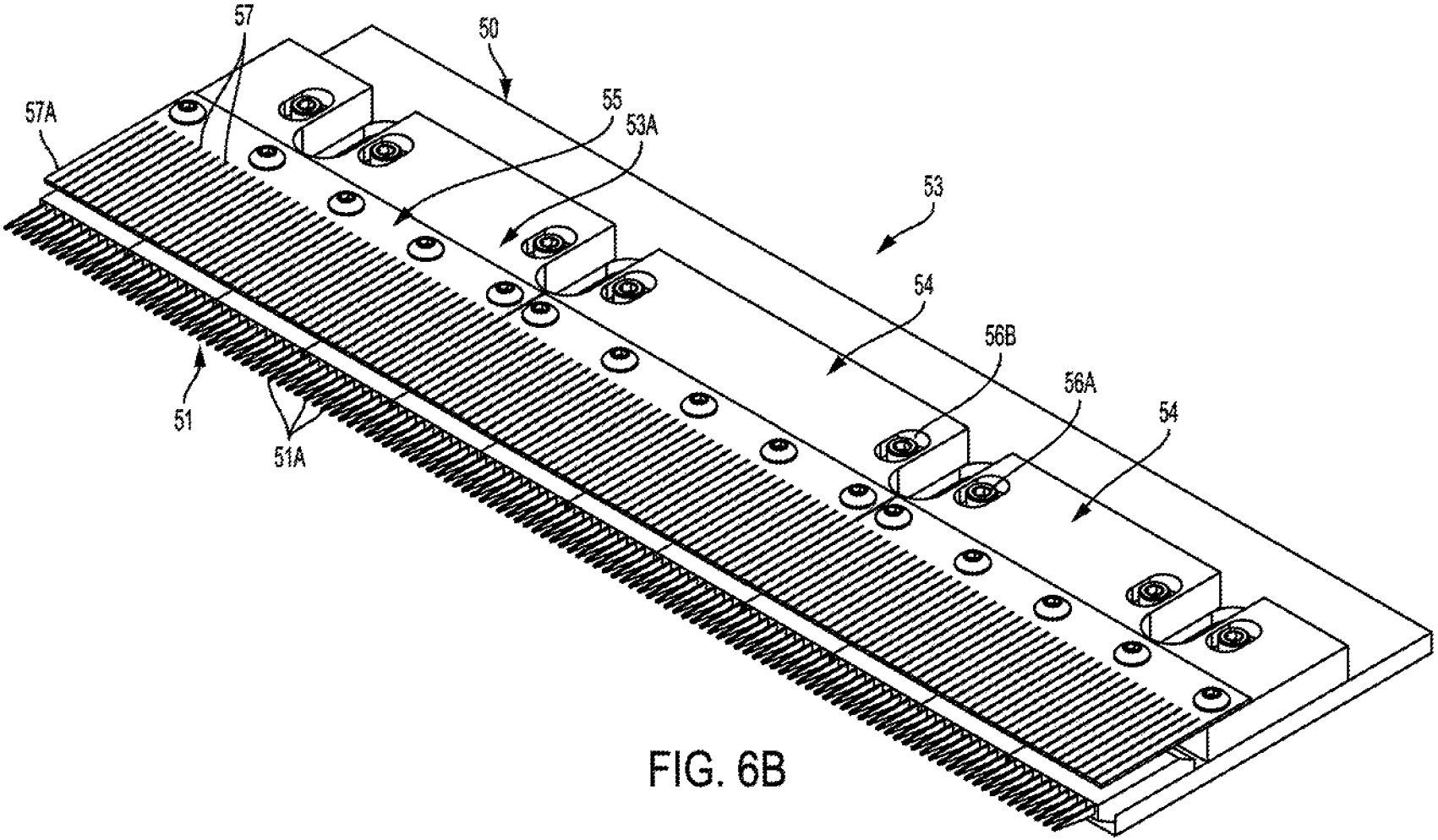
FIG. 6B is a perspective view of the needle plate and backing support of FIG. 6A.
Figure 7:
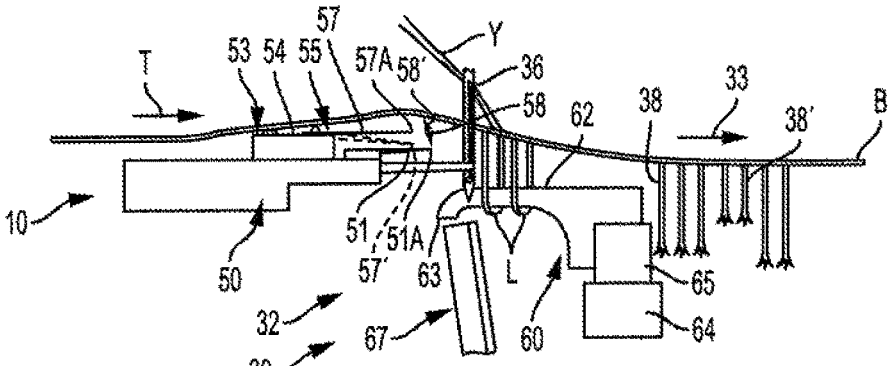
FIG. 7 is a side view schematically illustrating the formation of a series of cut pile tufts with different, varying pile heights in accordance with the principles of the present invention.

Each different yarn/color yarn that can be tufted at a particular stitch location or pixel thus can be presented to such stitch locations or pixels as the pattern is formed in the backing material. To accomplish such presentation of yarns at each pixel or stitch location, the needle bar(s) generally can be shifted as needed/desired per the calculated or selected cam profile or shift profile of the pattern to be run/formed, for example, using a combination of single and/or double jumps or shifts, based on the number of colors being run in the pattern and the area of the pattern field being formed by each specific color. Such a combination of single and double shift jumps or steps can be utilized to avoid over-tufting or engaging previously sewn tufts as the needle bar is shifted transversely and the backing material is advanced at its effective or operative stitch rate. The backing also can be shifted by backing or jute shifters, etc., either in conjunction with or separately from the needle bar shifting mechanism. Additionally, as the needles penetrate the backing material, the gauge parts such as cut pile hooks 60 (FIGS. 3A-3B and 6), and/or level cut loop loopers 70 (FIGS. 4A-4B and 8A-8B) positioned below the tufting zone T, also are reciprocated toward the tufting zone so as to engage and pick or pull loops of yarns from each of the needles.

For example, where level cut loop loopers 70 are utilized, as illustrated in FIGS. 4A-4B and 8A-8B, as the level cut loop loopers 70 are being moved into engagement with the needles to form/capture loops of yarns, their clips can be selectively actuated, and either will be released from the level cut loop loopers, or retained thereon for forming cut pile tufts. The clips of the level cut loop loopers each can be individually controlled so as to be selectively fired as needed, which actuation further can be coordinated with the movement of the stepping or shifting needle bar. As a result, for each step or shift of the needle bar according to the pattern, each level cut looper actuator can be controlled individually so as to selectively engage or retract its clip. When the clips are retracted, selected loops of yarns picked from the needles by the level cut loop loopers can be held or retained on the throats of the level cut loop loopers for cutting, thus forming cut pile tufts. In their extended positions, the clips will cause the loops of yarns engaged by the level cut loop loopers to be released to form either loop pile tufts, or further can be back-robbed or pulled out or sufficiently low to substantially avoid such non-selected ends of yarns occupying a selected stitch location or otherwise interfering with placement of a face or selected yarn(s) to be shown within a particular color field being formed according to the pattern instructions by operation of the pattern yarn feed attachment controlling the feeding of such yarns.

The yarn/color of yarn of each series of yarns being presented at each pixel or stitch location that is to be retained or shown on the face of the backing at a particular pixel or stitch location generally will be determined according to the pattern instructions or programming for the formation of the selected tufted pattern. When a yarn is presented to a pixel or stitch location, the yarn feed therefor can be selectively controlled to retain that yarn at that pixel or stitch location, and if the yarn is not to be appearing, it is not retained at the pixel or stitch location. The feeding of the yarns of such non-selected or non-appearing colors (i.e., the colors or types of yarns being sewn at that step or location, that are to be hidden and thus not visible in the particular color fields of the pattern to be shown on the face of the backing/tufted article) will be controlled so that these yarns will be back-robbed or pulled low, or out of the backing material by the yarn feed mechanisms feeding each of these yarns so as to float on the backing material. For the retained yarns/colors, i.e., the yarns appearing on the face of the patterned tufted article, the yarn feed mechanisms feeding on these yarns are controlled so as to feed an amount of yarn sufficient to form tufts of a desired type and pile height. The effective or operative process stitch rate (e.g., the actual rate at which stitches are formed in the backing) being run by the present invention further provides for a denser or compressed field of stitches or tufts per inch, so that the yarns being pulled low and/or back robbed are removed to an extent sufficient to avoid creation of undesired spaces or gaps between the retained face yarns (those appearing on the face of the tufted article according to the pattern) formed in the backing material. Additionally, the control system can perform yarn feed compensation and/or modeling of the yarn feed to help control and reduce the amount of non-retained or non-appearing yarns that may be "floating" on the back side of the backing material to further help reduce/minimize excess yarn feed and/or waste.

The control of the yarn feed further can be operated in conjunction with the biased support of the backing material by the backing support as the backing moves thereover to enable further variation of the pile heights of the retained tufts of yarns. As noted above, to form lower pile height tufts, the yarn feed being applied to selected needles of the needle bar(s) can be controlled to create a tightening or tension in the yarns as they are engaged and captured by the level cut loop loopers, as indicated in FIGS. 8A and 8B. For formation of lower pile loop pile tufts, the yarn feed can be controlled during the stroke of the needles so that a tension can be applied to the loops of yarns that are initially engaged and picked up by selected ones of the level cut loop loopers which further can be controlled so as to have their clips in an engaged or extended position to form loop pile tufts, or retracted to form cut pile tufts. As noted above, the tension force created in and applied by the yarns against the resilient spring plate or biasing portion of the backing support can be controlled so as to create a tension sufficient to cause the biasing portion 55 of the backing support, or at least fingers or portions 57 thereof against which the one or more portions of the backing are being pulled, to flex and/or bend and move downwardly, toward the needle plate. Thereafter, as the loops of yarns are released from the selected level cut loop loopers, the yarn feed can be further adjusted or controlled, for example, to allow a low pile loop 39' to remain within the backing material as needed to form a desired sculptured or textured pattern effect. The loop(s) further can be withdrawn from the backing material so as to be back robbed or pulled low or out of the backing material if not to be retained or shown/visible at the particular pattern pixel or stitch location being tufted.

With respect to cut pile tufts, as noted above, the operation of the loops of the level cut loop loopers can be controlled so that for formation of cut pile tufts at particular pixels or stitch locations, the clips of such level cut loop loopers can be moved or maintained in their retracted positions, enabling the level cut loop loopers to engage and capture and/or retain loops of yarns along the throat portions thereof. Thereafter, to vary the pile height of such cut pile tufts, the yarn feed can be controlled so that the tension applied to the loops of yarns corresponding to the selected cut pile tufts whose pile height is to be varied or lowered can be increased and/or varied to an extent sufficient to overcome the resilience or biasing or spring force of the biasing portion 55 of the backing support 53, and/or selected fingers or portions 57 thereof against which the backing or portions thereof are being pulled, so as to cause such fingers or sections of the biasing portion of the backing support to flex and be drawn or moved toward the needle support plate as needed to lower or otherwise vary the pile height of the resultant cut pile tufts.

Still further, in instances where, for example, a large color field, is being formed in the pattern wherein one or more non-appearing yarns of other colors (i.e., colors that will not be shown in the particular color field being tufted) would form extended length tails or back stitches across the backing material, the system controller running the stitch distribution control system of the present invention can control the yarn feed mechanisms to automatically run sufficient yarns to selectively form one or more low stitches as in the backing material, as opposed to completely back-robbing the non-appearing yarns from the backing material. Thus, the non-appearing yarns can be tacked or otherwise secured to the backing material, to prevent the formation of such extended length tails that can later become caught or cause other defects in the finished tufted article. The control system also can be programmed/set to tack or form low stitches of such non-appearing yarns at desired intervals, for example every 1 inch to 1.5 inches, although greater or lesser intervals also can be used. Yarn compensation also generally can be used to help ensure that a sufficient amount of yarns are fed when needed to enable the non-appearing yarns to be tacked into the backing material, while preventing the yarns from showing or bubbling up through another color, i.e., with the yarns being tacked into and projecting through one of the stitch yarns with several yarns being placed together. Additionally, where extended lengths or tails would be formed for multiple non-appearing yarns, the intervals at which such different yarns are tacked within the backing material can be varied (i.e., one at 1", another at 1.5", etc.,) so as to avoid such tacked yarns interfering with one another and/or the yarns of the color field being formed.

Accordingly, across the width of the tufting machine, the control system will control the shifting and feeding of the yarns of each color or desired pattern texture effect so that each color that can or may be sewn at a particular tuft location or pattern pixel will be presented within that pattern pixel space or tuft location for sewing, but only the selected yarn tufts for a particular color or pattern texture effect will remain in that tuft/stitch location or pattern pixel. As further noted, it is also possible to present additional or more colors to each of the loopers during a tufting step in order to form mixed color tufts or to provide a tweed effect as desired, wherein two or more stitches or yarn will be placed at desire pattern pixel or tuft location. The results of the operation of the stitch distribution control system accordingly provide a multi-color visual effect of pattern color or texture effects that are selectively placed in order to get the desired density and pattern appearance for the finished tufted article. This further enables the creation of a wider variety of geometric, free flowing and other pattern effects by control of the placement of the tufts or yarns at selected pattern pixels or tuft locations.

Accordingly, system and method for tufting sculptured and multiple pile height patterns articles of the present invention can enable an operator to develop and run a variety of tufted patterns having a variety of looks, textures, etc., at the tufting machine without necessarily having to utilize a design center to draw out and create the pattern. Instead, with the present invention, in addition to and/or as an alternative to manually preparing patterns or using a design center, the operator can scan an image (i.e., a photograph, drawing, jpeg, etc.,) or upload a designed pattern file at the tufting machine and the stitch distribution control system can read the image and develop the program steps or parameters to thereafter control the tufting machine substantially without further operator input or control necessarily required to form the desired tufted patterned article.

It will be understood by those skilled in the art that while the present invention has been discussed above with reference to particular embodiments, various modifications, additions and changes can be made to the present invention without departing from the spirit and scope of the present invention.

The invention claimed is:

1. A tufting machine, comprising:

backing feed rolls feeding a backing material through the tufting machine;

at least one needle bar carrying a series of needles;

a yarn feed mechanism feeding a plurality of yarns to a series of needles;

a series of gauge parts located below the backing material and movable toward the needles as the needles are reciprocated into the backing material to pick-up yarns therefrom;

a backing support over which the backing material passes, the backing support having a resilience; and a control system including programming for controlling feeding of selected yarns by the yarn feed mechanism to at least a portion of the needles such that the selected yarns picked up from the needles by the gauge parts are tensioned sufficient to overcome the resilience of the backing support;

wherein the tensioning of the selected yarns is controlled so as to cause at least a portion of the backing material to be moved toward a lowered position for forming a pattern of tufts of yarns in the backing material.

2. The tufting machine of claim 1, further comprising a shift mechanism for shifting at least some of the needles transversely across the backing material.

3. The tufting machine of claim 2, wherein the control system comprises programming for coordinating shifting of the needles by the shift mechanism and feeding of the backing material by the backing feed rolls, with control of the yarn feed mechanism so as to present a series of yarns of the plurality of yarns to selected stitch locations along the backing material as the backing material is moved at an effective operative stitch rate whereby an increased number of tufts per inch are formed in the backing material, with non-selected ones of the series of yarns presented being pulled low or out of the backing material while selected ones of the series of yarns presented are maintained at the selected stitch locations to form the pattern.

4. The tufting machine of claim 1 and wherein said gauge parts comprise level cut loop loopers, cut pile hooks, and/or combinations thereof.

5. The tufting machine of claim 1 and wherein said yarn feed mechanism comprises at least one of a scroll, roll, single end or double end yarn feed pattern attachment.

6. The tufting machine of claim 1, wherein the backing support comprises a spring plate supported at a location spaced above a needle plate, the spring plate comprising a series of spring fingers extending at least partially over the needle plate and along a path of travel of the backing material.

7. The tufting machine of claim 1, wherein the backing support comprises a series of sections, each section including at least one spring plate arranged at a selected elevation above the gauge parts and having a series of spaced spring fingers against which the backing material is pulled as a result of the tensioning of the selected yarns.

8. The tufting machine of claim 7 wherein the backing support further comprises spacers positioned below one or more of the series of sections, and wherein spacers are adjustably mounted so as to enable adjustment of the elevation of the spring fingers of corresponding ones of the sections with respect to the needles.

9. A method of forming a tufted article, comprising:

moving a backing material along a backing support with at least a portion of the backing material guided over the backing support in an elevated position;

reciprocating a series of needles carrying a plurality of yarns into and out of the backing material;

picking loops of yarns from the needles with a series of gauge parts located below the backing material;

controlling feeding of selected yarns so as to create tension in the selected yarns;

controlling the tension in the selected yarns sufficient to overcome a resiliency of the backing support over which the backing material is moved; and as the tension in the selected yarns is increased, drawing at least a portion of the backing material downwardly toward a lowered position to form the tufted article with selected pattern effects.

10. The method of claim 9, wherein moving the backing material along the backing support comprises feeding the backing material at an effective operative stitch rate approximately equivalent to a fabric stitch rate for the tufted article increased by a selected amount to form the pattern.

11. The method of claim 9, further comprising presenting a desired number of yarns for insertion into the backing material at selected stitch locations of a pattern of the tufted article being formed and withholding selected yarns from such stitch locations, and wherein presenting a desired number of yarns comprises shifting at least some of the needles carrying the plurality of yarns transversely with respect to the feeding of the backing material.

12. A method of tufting to form a patterned tufted article having a desired pattern stitch rate, comprising:

threading a series of needles with different color or type yarns in a selected sequence;

moving a backing material through a tufting zone at an actual stitch rate that is at least two times the desired pattern stitch rate for the patterned tufted article;

as the backing material moves through the tufting zone, directing at least a portion of the backing material toward an elevated position;

shifting at least a portion of the needles across the backing material sufficient to present a series of different color or type yarns to a series of stitch locations in the backing material;

picking loops of yarns from the needles with a series of gauge parts;

controlling feeding of the series of different color or type yarns presented to selected ones of the stitch locations, and retaining at least one desired yarn of the series of different color or type of yarns presented at each of the selected ones of the stitch locations so as to form tufts of the desired yarns at the selected ones of the stitch, with remaining ones of the series of yarns presented at the selected stitch locations being at least partially removed from the backing material; and tensioning one or more of the yarns retained at one or more of the selected stitch locations sufficient to draw at least a portion of the backing material from its elevated position toward a lowered position to form selected pattern effects of the patterned tufted article.

13. The method of claim 12 and wherein the selected pattern effects comprise forming tufts of yarns with multiple pile heights, controlled transitions between higher and lower pile tuft fields or areas, shading effects, sculptured textures, cut pile and loop pile tufts of yarns in one or more same tuft rows, cut pile and loop pile tufts of yarns in different tuft rows, placement of selected colors of yarns, or combinations thereof.

14. The method of claim 12, wherein tensioning one or more of the yarns retained at one or more of the selected stitch locations comprises controlling feeding of the one or more yarns so as to draw a loop of the at least one desired yarn substantially tight against a gauge part along which the loop of yarn is engaged sufficient to overcome a resiliency of a backing support directing the backing material toward its elevated position, and enable movement of the backing material toward its lowered position.

15. The method of claim 12, further comprising cutting the loops of the desired yarns to form cut pile tufts.

16. The method of claim 12, further comprising selectively activating clips of level cut loop loopers to form loop and cut pile tufts.

17. A tufting machine, comprising:

a yarn feed mechanism feeding a plurality of yarns to a series of needles, the needles moving in a reciprocal motion into and out of a backing material;

backing feed rolls feeding a backing material along a path of travel below the needles and over a backing support wherein at least a portion of the backing material is directed toward a raised position;

a series of gauge parts arranged below the path of travel of the backing material and configured to pick up loops of yarns from the needles; and a control system including programming for controlling the backing feed rolls and for controlling feeding of the yarns to the needles by the yarn feed mechanism for presenting a series of yarns to stitch locations along the backing material and retaining selected yarns of the series of yarns presented to form tufts of yarns in the backing material;

wherein at least some of the gauge parts comprise level cut loop loopers, each having a body comprising a shank and a throat having a bottom edge spaced at least approximately 0.10" above the shank, and a clip moveable along the body between extended and retracted positions.

18. The tufting machine of claim 17, wherein each of the level cut loop loopers further comprises a hook or bill that extends downwardly from the throat approximately 0.04"-0.75".

19. The tufting machine of claim 17, wherein the backing support comprises a plate mounted along the path of travel of the backing material, wherein the backing support has a resilience and is configured to direct the backing material toward the elevated position.

20. The tufting machine of claim 19, wherein the control system controls feeding of the yarns to tension selected loops of yarns picked up by the gauge parts sufficient to overcome the resilience of the backing support and urge the backing material toward a lower position for forming tufts of yarns with varying pile heights.

21. The tufting machine of claim 17, wherein the throats and clips of the level cut loop loopers further comprise an extended length configured to provide an extended dwell time of the loops of yarns picked from the needles before release from the level cut loop loopers to form tufts of yarns with selected pattern effects.

* * * * *